US006308981B1

(12) United States Patent
Proehl

(10) Patent No.: US 6,308,981 B1
(45) Date of Patent: Oct. 30, 2001

(54) TRANSFER LIFT

(75) Inventor: Marcus L. Proehl, Angola, IN (US)

(73) Assignee: Sisbro, LLC, Clayton, IN (US)

( * ) Notice: Subject to any disclaimer, the term of this patent is extended or adjusted under 35 U.S.C. 154(b) by 0 days.

(21) Appl. No.: 09/114,200

(22) Filed: Jul. 13, 1998

(51) Int. Cl.[7] ..... A61G 5/08

(52) U.S. Cl. ..... 280/657; 280/647; 280/47.34; 5/86.1

(58) Field of Search ..... 280/304.1, 639, 280/642, 647, 650, 657, 87.01, 47.131, 47.17, 47.2, 47.25, 47.34, 47.38, 79.2, 79.3, 62; 5/86.1, 81.1 R; 414/921

(56) References Cited

U.S. PATENT DOCUMENTS

| | | | | |
|---|---|---|---|---|
| 2,781,225 | * | 2/1957 | Heideman | 280/642 |
| 3,075,783 | * | 1/1963 | Flam | 280/650 |
| 3,084,949 | * | 4/1963 | Forster et al. | 280/650 |
| 3,165,314 | * | 1/1965 | Clearman et al. | 280/47.34 |
| 3,550,998 | * | 12/1970 | Boudreau et al. | 280/650 |
| 3,693,996 | * | 9/1972 | Hardy | 280/79.3 |
| 4,510,633 | * | 4/1985 | Thorne | 280/304.1 |
| 4,864,334 | * | 9/1989 | Ellis | 280/47.2 |
| 4,902,027 | * | 2/1990 | Skelly | 280/62 |
| 5,093,944 | * | 3/1992 | Winston, Sr. | 280/47.25 |
| 5,148,557 | * | 9/1992 | Fridman et al. | 5/86.1 |
| 5,189,741 | * | 3/1993 | Beardmore | 5/86.1 |
| 5,233,708 | * | 8/1993 | Winston, Sr. | 280/47.25 |
| 5,460,399 | * | 10/1995 | Baechler et al. | 280/650 |
| 5,489,258 | * | 2/1996 | Wohnsen et al. | 5/86.1 |

FOREIGN PATENT DOCUMENTS

| | | | | |
|---|---|---|---|---|
| 880333 | * | 3/1943 | (FR) | 280/47.17 |
| 956468 | * | 2/1950 | (FR) | 280/47.12 |
| 2043547 | * | 10/1980 | (GB) | 280/47.2 |

* cited by examiner

*Primary Examiner*—Frank Vanaman
(74) *Attorney, Agent, or Firm*—Woodard, Emhardt, Naughton, Moriarty & McNett

(57) ABSTRACT

An invalid dolly for transporting an individual such as a patient or invalid between various sitting locations, for example, on a bed, on a toilet, or in a wheelchair, has a pair of front wheels with a pair of fixed crutch tips in front of and slightly above the front wheels, a pair or rear caster wheels, a diagonally upwardly extending handle, a padded cushion and hand and foot crossbars. The dolly is tipped toward the individual to a position where the handle is nearly vertical and the dolly is resting on the pair of fixed crutch tips. The patient grips a crossbar handle with his chest or stomach against the cushion and with his feet resting on a footbar. The helper or orderly then draws the handle toward him pivoting the dolly onto a pair of front wheels and eventually also onto a pair of rear casters 21. The patient is then resting on the cushion and is wheeled to a new location and the process reversed to deposit him again in a sitting position.

12 Claims, 1 Drawing Sheet

TRANSFER LIFT

SUMMARY OF THE INVENTION

The present invention relates generally to a device for moving an invalid and more particularly to a dolly for aiding anyone with difficulty walking or standing to move between various sitting locations.

Persons with problems standing or walking are frequently restricted to wheel chairs. These individuals have great difficulty moving from the wheel chair to bed or onto a toilet. The horizontal bars commonly found fixed to the walls of handicapped toilet stalls are one solution, but these are limited to use at the particular location. At many locations, placement of such a bar is not possible. Further, many invalids lack the upper body strength to effectively use these bars as an aid in moving from one sitting location to another.

Among the several objects of the present invention may be noted the provision of a dolly for transferring a bedfast or wheel chair bound patient or similar invalid between various sitting locations; the provision of a push cart for moving an invalid from one location to another; and the provision of a collapsible push cart. These as well as other objects and advantageous features of the present invention will be in part apparent and in part pointed out hereinafter.

In general, a push cart for moving an invalid from one location to another has four wheels, a foot rest, a hand grip region, and a cushion all relatively located so that the invalid may assume a bent over position and simultaneously have his feet on the foot rest and his hands gripping the hand grip region while the ventral portion of his chest and abdomen rest on the cushion. There may be a pair of pivot pads located below and outwardly of the foot rest and beyond the four wheels so that the cart may be pivoted beginning on the front two of the four wheels and then onto the pivot pads to rotate the invalid into a sitting position on a bed, wheel chair, toilet or the like.

BRIEF DESCRIPTION OF THE DRAWING

Corresponding reference characters indicate corresponding parts throughout the several views of the drawing.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 1:
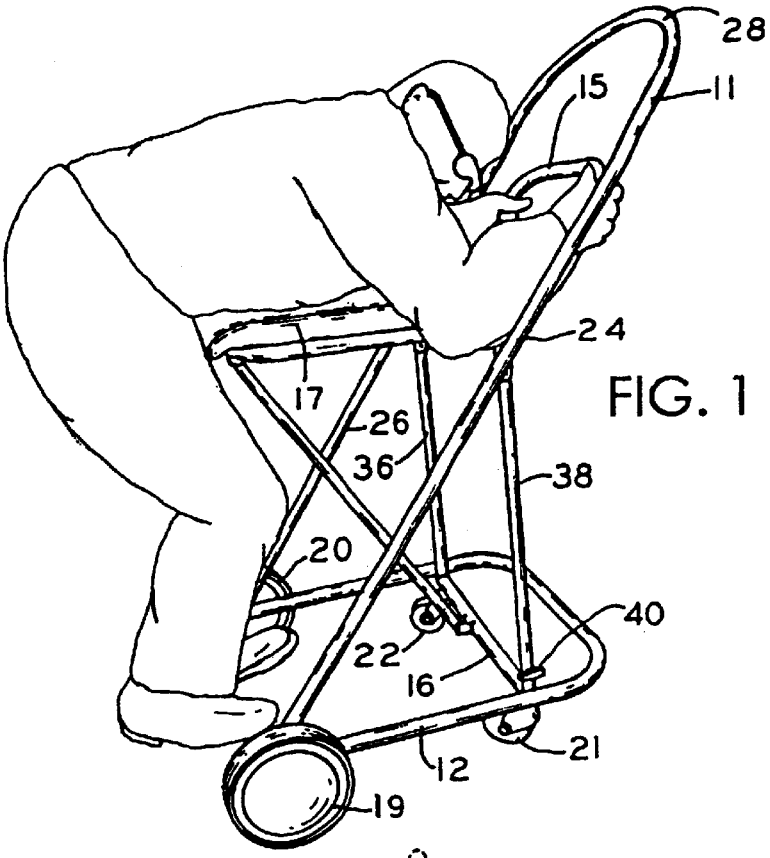
FIG. 1 is a perspective view of a patient transfer dolly with a patient in position for transfer to a new location.
Figure 2:
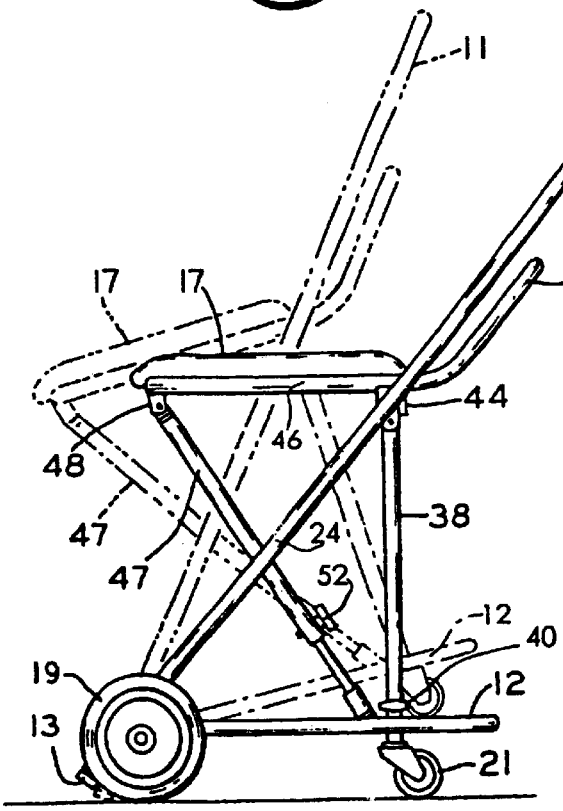
FIG. 2 is a side elevation view of the dolly of FIG. 1 including a fantom illustration of the dolly tipped into an attitude to position or receive a patient.
Figure 3:
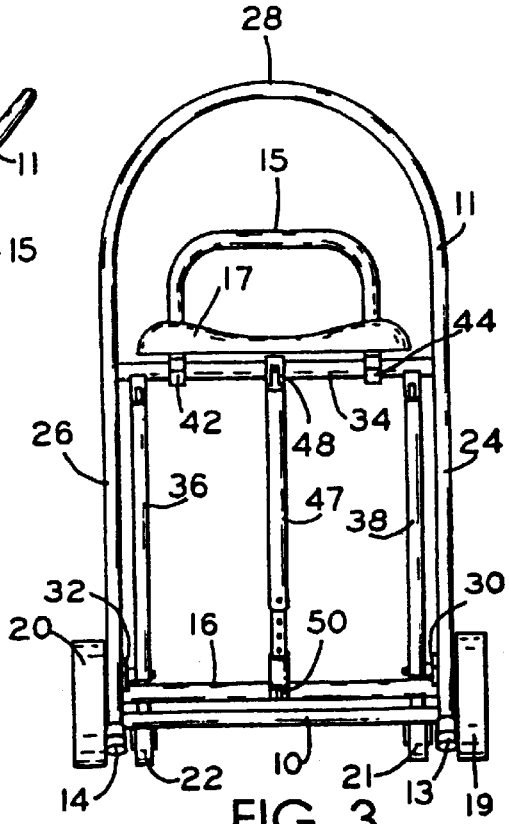
FIG. 3 is a front elevation view of the dolly of FIGS. 1 and 2.

A collapsible push cart or dolly for moving invalids between various sitting positions is shown in FIGS. 1–3 and includes a generally U-shaped lower frame member having a first crossbar 10 near the open end of the U and a second intermediate crossbar 16. There are a pair of front wheels 19 and 20 having the first crossbar 10 as a common axle and a pair of caster wheels 21 and 22 fixed to the intermediate crossbar 16 for swiveling motion. The front wheels 19 and 20 are located near the leading or front edge of the dolly and there are a pair of fixed pivot feet 13 and 14 located in front of and slightly above the front wheels 19 and 20. The dolly has a generally U-shaped diagonal main frame member 11 including a pair of straight diagonal members 24 and 26 which extend upwardly and backwardly to a location generally above and behind the rear wheels where they are joined by a U-shaped handle region 28 at their upper ends. Handle 28 is for pushing the cart. The fixed pivot feet 13 and 14 may comprise a pair of crutch tips fitted over lower end portions of the diagonal main frame members 24 and 26. The U-shaped main frame member 11 is pivotally attached near its open U end to the open U end of the lower frame member by a pair of hinges 30 and 32. Finally, the main frame member 11 includes a third intermediate crossbar 34 from which a pair of upright braces pivotally extend downwardly to a location where they are removably affixed to the second crossbar 16 by removable pins such as 40.

A cushion 17 is pivotally attached to the third crossbar 34 by a pair of removable blocks 42 and 44. The cushion rests on a tubular frame 46 which includes the U-shaped hand hold 15 which is located generally above the rear wheels 21, intermediate the diagonal frame members 24 and 26, and extends obliquely away from the cushion. The cushion further rests on a selectively yieldable diagonal brace 47 which has one end pivotally affixed to a central portion of the second crossbar 16 by hinge 50 and the other end pivotally affixed to the cushion at hinge 48.

The diagonal brace 47 comprises a pair of telescoping tubular members with the upper member having a transverse hole and the lower member having a plurality of transverse holes. A transverse pin 52 selectively passing through the transverse hole and any one of the plurality of transverse holes to fix the length of the diagonal brace at a selected preferred distance and thus the attitude of the cushion 17. The diagonal brace is yieldable to collapse the cart and may be separated by removing pin 52 with one half of the brace remaining attached to crossbar 16 and the other remaining attached to seat frame 46. The two piece blocks 42 and 44 which join the handle-cushion assembly to the cross-member 34 of the main frame may be dissembled allowing the hand grip portion and the cushion to be removed from the third crossbar so that the cushion, hand grip portion and the pivotally attached one of the tubular members may be separated from the remainder of the cart for shipping or storage. When so separated, the hand grip nests within the remainder of the framework for a more compact package for shipping or storage.

The method of operation of the invention should now be clear. The dolly is located in a position with the patient facing it and in a sitting position. The device is the tipped forward on the tips 13 and 14 toward the patient until the handle 11 is nearly vertical and resting on the crutch tips 13 as shown in, phantom lines in FIG. 2. The patient grips the handle 15 with his chest or stomach against the cushion 17. The helper (orderly etc.) then draws the handle 11 toward him pivoting the dolly and patient onto the wheels 19 and 20 and eventually also onto the casters 21 and 22. The patient is then wheeled to another location and the process reversed to deposit him sitting on a bed, toilet, into a wheelchair or other sitting position.

In summary, the invention has a number of advantages over known prior devices. A relatively small or weak person can easily transfer a much heavier invalid between sitting positions. It can be used at virtually any location where a sitting invalid may be found. The dolly is easily collapsed for transportation, for example, in the trunk of an automobile, and the wheels and handle may additionally be removed for shipping or storage in a 10" by 24 " box.

From the foregoing, it is now apparent that a novel patient transfer arrangement has been disclosed meeting the objects and advantageous features set out hereinbefore as well as others, and that numerous modifications as to the precise shapes, configurations and details may be made by those having ordinary skill in the art without departing from the spirit of the invention or the scope thereof as set out by the claims which follow.

What is claimed is:

1. A collapsible push cart comprising a generally U-shaped lower frame member having a first crossbar near the open end of the U and a second intermediate crossbar; a pair of front wheels having the first crossbar as a common axle; a pair of caster wheels fixed for swiveling motion to the second crossbar; a generally U-shaped main frame member pivotally attached near its open U end to the open U end of the lower frame member and having a third intermediate crossbar, the closed U end of the main frame member forming a handle for pushing the cart; and a pair of upright braces pivotally attached to the third crossbar and removable affixed to the second crossbar; and a cushion pivotally attached to the third crossbar and a selectively yieldable diagonal brace having one end pivotally attached to a central portion of the second crossbar and the other end pivotally attached to the cushion at a location remote from the third crossbar, the diagonal brace yielding to collapse the cart.

2. The push cart of claim 1 wherein the diagonal brace comprises a pair of telescopically nesting tubes, a transverse hole in one tube and a plurality of transverse holes in the other tube, and a pin for passing through one transverse hole in each of the pair of tubes to thereby selectively join the pair of tubes at any of several selectable lengths and therefor also position the cushion in any one of several selectable attitudes.

3. The push cart of claim 1 wherein the diagonal brace comprises a pair of telescoping tubular members, one member having a transverse hole and the other member having a plurality of transverse holes, and a transverse pin selectively passing through the transverse hole and any one of the plurality of transverse holes to fix the length of the diagonal brace at a selected preferred distance.

4. The push cart of claim 1 further including a hand grip portion extending obliquely away from the cushion.

5. The push cart of claim 4 wherein the hand grip portion and the cushion are selectively removable from the third crossbar so that the cushion, hand grip portion and the said other end of the diagonal brace pivotally attached to the cushion may be separated from the remainder of the cart for shipping or storage.

6. The push cart of claim 4 further including a transverse foot rest, the foot rest, hand grip portion, and cushion being relatively located so that an invalid may assume a bent over position and simultaneously have his feet on the foot rest and his hands gripping the hand grip region while the ventral portion of his chest and abdomen rest on the cushion.

7. A push cart comprising a generally U-shaped lower frame member having a first crossbar near the open end of the U and a second crossbar; a pair of front wheels adjacent the first crossbar; a pair of caster wheels attached for swiveling motion to the second crossbar; a main frame member having parallel sides with lower ends of the sides attached to the open U end of the lower frame member and having a third crossbar closing its upper end, and a pair of upright braces attached to the third crossbar and affixed to the second crossbar;

said lower ends of said main frame member sides are pivotally attached to the open U-end of the lower frame member;

said upright braces are pivotally attached to said third crossbar and removably affixed to the second crossbar;

whereby said push cart is collapsible; and a cushion pivotally attached to the third crossbar and a selectively yieldable diagonal brace having one end pivotally attached to a portion of the second crossbar and the other end pivotally attached to the cushion at a location remote from the third crossbar, the diagonal brace yielding to collapse the cart.

8. The push cart of claim 7 wherein the diagonal brace comprises a pair of telescopically nesting tubes, a transverse hole in one tube and a plurality of transverse holes in the other tube and a pin for passing through one transverse hole in each of the pair of tubes to thereby selectively join the pair of tubes at any of several selectable lengths and therefor also position the cushion in any one of several selectable attitudes.

9. The push cart of claim 7 wherein the diagonal brace comprises a pair of telescoping tubular members, one member having a transverse hole and the other member having a plurality of transverse holes, and a transverse pin selectively passing through the transverse hole and any one of the plurality of transverse holes to fix the length of the diagonal brace at a selected preferred distance.

10. The push cart of claim 7 further including a hand grip portion extending obliquely away from the cushion.

11. The push cart of claim 10 wherein the hand grip portion and the cushion are selectively removable from the third crossbar so that the cushion, hand grip portion and the said other end of the diagonal brace pivotally attached to the cushion may be separated from the remainder of the cart for shipping or storage.

12. The push cart of claim 11 further including a transverse foot rest, the foot rest, hand grip portion, and cushion being relatively located so that an invalid may assume a bent over position and simultaneously have his feet on the foot rest and his hands gripping the hand grip region while the ventral portion of his chest and abdomen rest on the cushion.

* * * * *